US006913475B2

(12) United States Patent
Hsu

(10) Patent No.: US 6,913,475 B2
(45) Date of Patent: Jul. 5, 2005

(54) ELECTRIC PLUG

(75) Inventor: Jung-Hui Hsu, Hsin Chuang (TW)

(73) Assignee: Powertech Industrial Co., Ltd., Taipei Hsien (TW)

( * ) Notice: Subject to any disclaimer, the term of this patent is extended or adjusted under 35 U.S.C. 154(b) by 0 days.

(21) Appl. No.: 10/737,809

(22) Filed: Dec. 18, 2003

(65) Prior Publication Data

US 2005/0106912 A1 May 19, 2005

(30) Foreign Application Priority Data

Nov. 19, 2003 (TW) ..... 92220473 U

(51) Int. Cl.[7] ..... H01R 13/62
(52) U.S. Cl. ..... 439/160; 439/172
(58) Field of Search ..... 439/159, 160, 439/131, 172, 135, 372

(56) References Cited

U.S. PATENT DOCUMENTS 2,134,345 A * 10/1938 Sheeran ..... 439/160
3,926,494 A * 12/1975 Maillaro ..... 439/159
4,326,763 A * 4/1982 Ristovski ..... 439/159
5,085,591 A * 2/1992 Warren et al. ..... 439/131
5,266,040 A * 11/1993 Merrill et al. ..... 439/159
5,480,313 A * 1/1996 d'Alayer de Costemore d'Arc ... 439/159
5,679,014 A * 10/1997 Lan-Jen ..... 439/160
6,062,883 A * 5/2000 Schreiber et al. ..... 439/159

* cited by examiner

*Primary Examiner*—Briggitte R. Hammond
(74) *Attorney, Agent, or Firm*—Troxell Law Office, PLLC

(57) ABSTRACT

An electric plug is constructed to include a housing having metal contact members for insertion into the insertion slots of an electric socket to obtain power supply, a front cover sealed to the front side of the housing, a follower member supported on the spring member inside the front cover, and a lever pivoted to the housing for pressing by hand to force the follower member out of the front cover against the electric socket for enabling the metal contact members to be easily removed from the insertion slots of the electric socket when separating the electric plug from the electric socket.

8 Claims, 4 Drawing Sheets

ELECTRIC PLUG

BACKGROUND OF THE INVENTION

1. Field of the Invention

The present invention relates to electric plugs and, more particularly, to such an electric plug, which can easily be separated from the electric socket with less effort.

2. Description of the Related Art

Electric plugs and sockets are commonly used in electric appliances for receiving power supply. Different designs of electric plugs and sockets may be used in different countries. However, these electric plugs and sockets are operated in the same way. An electric plug has two metal contact blades for insertion into the insertion slots of an electric socket. There are electric plugs having a grounding prong. The metal contact members (metal contact blades and grounding prong) must match the insertion slots of an electric socket perfectly so that the electric plug can be maintained electrically and positively connected to the electric socket.

When separating an electric plug from an electric socket, the user may have to employ much effort to pull the electric plug outwards from the electric socket. Sometimes, the user may have to use the both hands to pull the electric plug away from the electric socket. In order to eliminate this drawback, easy-to-plug-and-pull electric plugs are developed.

A known electric plug of this design comprises a lug protruded from the housing at one side, a lever pivoted to the lug, two horizontal push plates, and a tensile spring stopped between and inside wall of the housing and the lever. When pressed the lever with the hand, the push plates are forced against the electric socket, imparting a reactive force to the housing to force the metal contact blades of the housing outwards from the electric socket. This design of electric plug is still not satisfactory in function. Because the lever is provided at one side of the housing, the side push force produced by pressing the lever tends to bias the metal contact blades, resulting in loosening of the internal parts of the electric plug.

SUMMARY OF THE INVENTION

The present invention has been accomplished under the circumstances in view. It is the main object of the present invention to provide an electric plug, which can easily and stably be inserted into the matching electric socket and easily separated from the matching electric socket with less effort.

It is still another object of the present invention to provide an electric plug, which keeps the metal contact members in direction without biasing when separating the electric plug from the matching electric socket. According to one aspect of the present invention, the electric plug comprises an electrically insulative housing, the housing comprising a plurality of metal contact members forwardly extended from a front side thereof for insertion into the insertion slots of an electric socket, a recessed front open chamber, and a pivot holder protruded from an outside wall thereof at one side of the front open chamber; a front cover sealed to the front side of the housing, the front cover having an opening for the passing of the metal contact members of the housing, and a pivot holder attached to the pivot holder of the housing; a lever formed of a substantially L-shaped frame member and pivoted to the housing and the front cover, the lever comprising a finger strip disposed at one end outside the housing, at least one actuating rod disposed ate an opposite end and suspended in the recessed front open chamber of the housing, and a pivot transversely connected between the finger strip and the at least one actuating rod and fastened pivotally with the pivot holder of the housing and the pivot holder of the front cover; and a follower member mounted in between the metal contact members of the housing within the front cover, the follower member having a rear base stopped at the at least one actuating rod of the lever, and a front block forwardly extended from the rear base and suspended in between the metal contact members of the housing. When pressed the finger strip of the lever with the finger after connection of the electric plug to a matching electric socket, the follower member is forced out of the opening of the front cover by the at least one actuating rod of the lever and stopped against the matching electric socket, thereby causing the metal contact members of the housing to be separated from the insertion slots of the matching electric socket.

According to another aspect of the present invention, the follower member comprises a plurality of through holes through the front block and the rear base; the front cover comprises a plurality of inside guide rods respectively inserted into the through holes of the follower member; and a spring member is supported between the front block of the follower member and an inside wall of the front cover to force the follower member away from the front cover toward the housing.

BRIEF DESCRIPTION OF THE DRAWINGS

The present invention can be more fully understood by reference to the following detailed description and accompanying drawings, in which.

DETAILED DESCRIPTION OF THE PREFERRED EMBODIMENT

Figure 1:
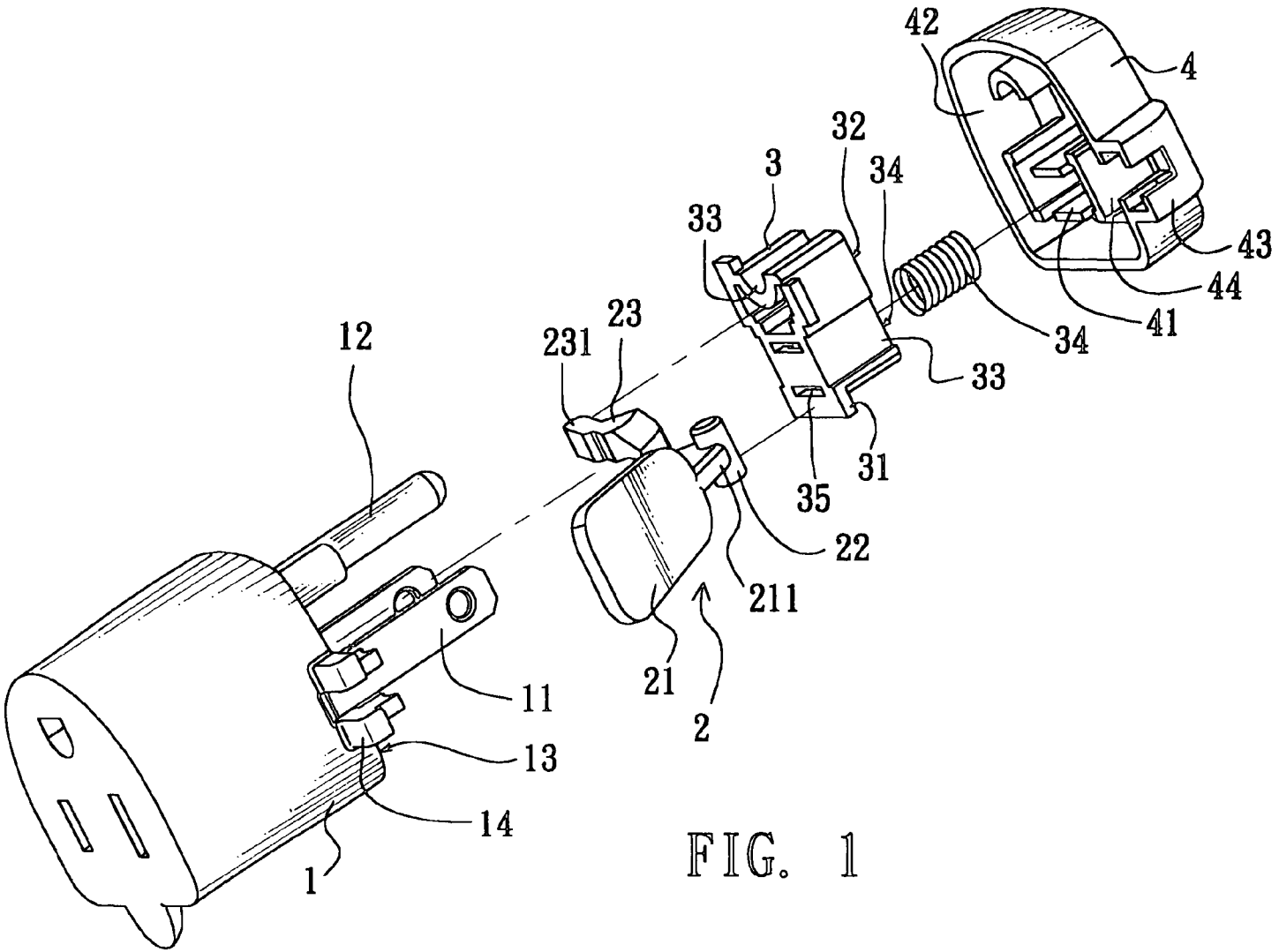
FIG. 1 is an exploded view of an electric plug according to the present invention.
Figure 2:
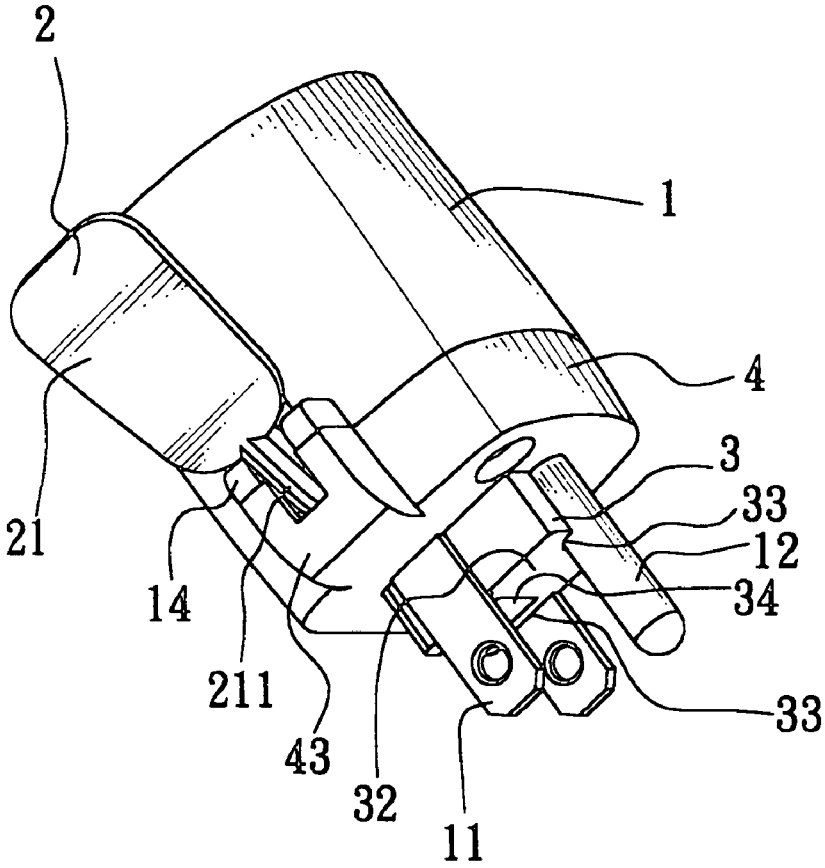
FIG. 2 is an elevational assembly view of the electric plug according to the present invention.

Referring to FIGS. 1 and 2, an electric plug in accordance with the present invention is shown comprised of an electrically insulative housing 1, a lever 2, a follower member 3, and a front cover 4.

Similar to conventional designs, the housing 1 has two metal contact blades 11 and/or grounding prong 12. Differentiated from conventional designs, the housing 1 has a recessed front open chamber, for example, a substantially U-shaped open chamber 13, and a pivot holder formed of a smoothly arched flange 14 protruded from the peripheral wall at one side of the open chamber 13 for accommodating the lever 2.

The lever 2 is a substantially L-shaped frame member having a finger strip 21 disposed at one end, at least one, for example, two actuating rods 23 disposed at the other end and forming a forked structure, a pivot 22 transversely provided between the finger strip 21 and the actuating rods 23, and a stop plate 211 connected between the finger strip 21 and the pivot 22. The actuating rods 23 each have the respective free end terminating in a sector-like face 231 adapted to push the follower member 3. The actuating rods 23 are spaced from each other at a distance. When the user operates the lever 2 to move the follower member 3, the actuating rods 23 do not touch the metal contact blades 11. Further, the stop plate 211 prevents friction between the lever 2 and the pivot holder 14 of the housing 1 upon up stroke of the lever 2.

The follower member 3 is a block member mounted in between the metal contact blades 11, having a rear base 31 attached to the sector-like face 231 of each actuating rod 23 of the lever 2, a front block 32, at least one guide groove 33 formed in the front block 32 corresponding to the metal contact blades 11 and or grounding prong 12 for enabling the follower member 3 to be moved along the metal contact blades 11 and/or grounding prong 12 when forced by the sector-like faces 231 of the actuating rods 23 of the lever 2.

The follower member 3 further comprises a front notch 34 in the front side of the front block 32, and two through holes 35 formed in the front notch 34 and extended through the rear base 31 for receiving two guide rods 41 of the front cover 4. The spring member 5 is positioned in the front notch 34 and stopped between the front block 32 of the follower member 3 and the inside wall of the front cover 4, and adapted to return the front cover 4 automatically after the front cover 4 being pressed. Because the spring member 5 is surrounded by the guide rods 41 and the peripheral walls of the front notch 34, it is prohibited from touching the metal contact blades 11 and/or the grounding prong 12.

The front cover 4 is sealed to the front side of the housing 1, having an opening 42 for the passing of the metal contact blades 11 and/or the grounding prong 12 to obtain power supply, a pivot holder formed of an axle housing 43 and attached to the pivot holder 14 of the housing 1 to hold the pivot 22 of the lever 2, and inside guide plates 44 adapted to support the metal contact blades 11 and/or the grounding prong 12, for enabling the metal contact blades 11 and/or the grounding prong 12 to be stably inserted into or removed from the insertion slots of the matching electric socket. When assembled, the front cover 4 is sealed to the housing 1 by, for example, a high-frequency sealing apparatus.

Figure 3:
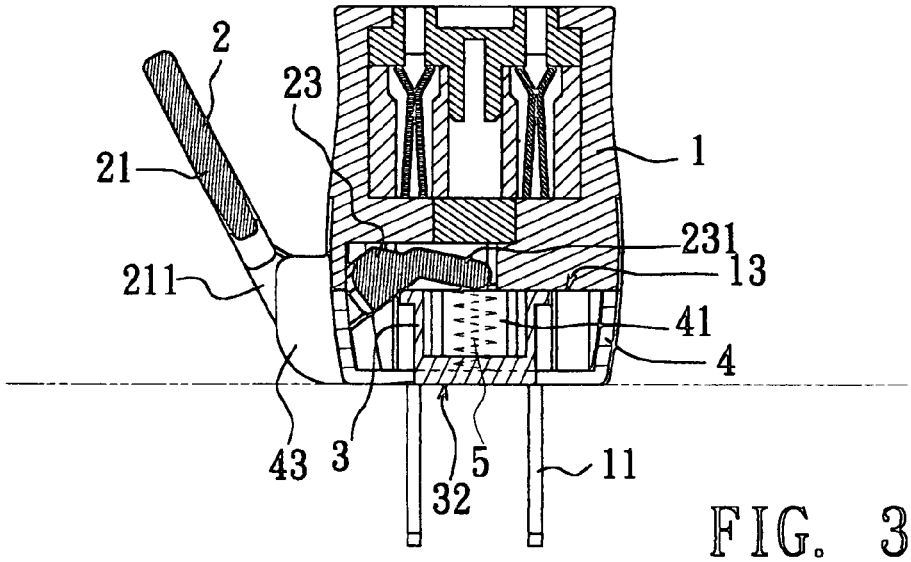
FIG. 3 is a sectional view of the present invention, showing the electric plug connected to an electric socket.
Figure 4:
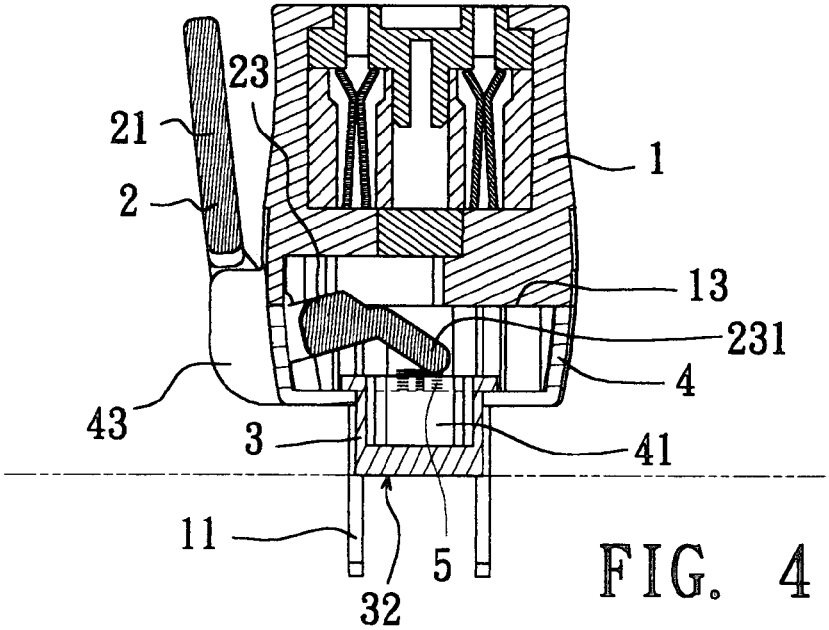
FIG. 4 is similar to FIG. 3 but showing the lever pressed and the follower member forced against the electric socket.

Referring to FIGS. 3 and 4, when in use, the metal contact blades 11 and/or the grounding prong 12 are inserted into the corresponding insertion slots of the matching electric socket to obtain power supply from the matching electric socket. This use is same as conventional electric plugs. When separating the electric plug from the matching electric socket, press the finger strip 21 to turn the pivot 22 in the pivot holders 14 and 43, thereby causing the sector-like faces 231 of the actuating rods 23 to push the follower member 3 forwardly out of the opening 42 of the front cover 4 against the housing of the matching electric socket, and therefore the metal contact blades 11 and/or the grounding prong 12 are moved outwards from the insertion slots of the matching electric socket.

Because the follower member 3 is set in between the metal contact blades 11 of the housing 1, applied force is given through the lever 2 to the follower member 3 evenly, enabling the metal contact blades 11 and/or the grounding prong 12 to be smoothly separated from the matching electric socket with less effort.

A prototype of electric plug has been constructed with the features of FIGS. 1~4. The electric plug functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An electric plug comprising:

an electrically insulative housing, said housing comprising a plurality of metal contact members forwardly extended from a front side thereof for insertion into insertion slots of an electric socket, a recessed front open chamber, and a pivot holder protruded from an outside wall thereof at one side of said front open chamber;

a front cover sealed to the front side of said housing, said front cover having an opening for passing of the metal contact members of said housing, and a pivot holder attached to the pivot holder of said housing;

a lever formed of a substantially L-shaped frame member and pivoted to said housing and said front cover, said lever comprising a finger strip disposed at one end outside said housing, at least one actuating rod disposed at an opposite end and suspended in the recessed front open chamber of said housing, and a pivot transversely connected between said finger strip and said at least one actuating rod and fastened pivotally with the pivot holder of said housing and the pivot holder of said front cover; and a follower member mounted in between the metal contact members of said housing within said front cover, said follower member having a rear base stopped at the at least one actuating rod of said lever, and a front block forwardly extended from said rear base and suspended in between the metal contact members of said housing;

wherein when a finger presses said finger strip of said lever after connection of the electric plug to a matching electric socket, said follower member is forced out of the opening of said front cover by the at least one actuating rod of said lever and stopped against the matching electric socket, thereby causing the metal contact members of said housing to be separated from the insertion slots of the matching electric socket.

2. The electric plug as claimed in claim 1, wherein the number of said at least one actuating rod is two pieces, and the two actuating rods form a forked structure.

3. The electric plug as claimed in claim 1, wherein said lever further comprises a stop plate connected between said finger strip and said pivot.

4. The electric plug as claimed in claim 1, wherein the pivot holder of said housing is a smoothly arched flange, and the pivot holder of said front cover is an axle housing attached to said smoothly arched flange to hold said pivot of said lever in between said smoothly arched flange and said axle housing.

5. The electric plug as claimed in claim 1, wherein said follower member comprises a plurality of guide grooves formed in said front block corresponding to the metal contact members of said housing.

6. The electric plug as claimed in claim 1, wherein said front cover comprises a plurality of inside guide plates adapted to support the metal contact members of said housing.

7. The electric plug as claimed in claim 1, wherein said follower member comprises a plurality of through holes through said front block and said rear base; said front cover comprises a plurality of inside guide rods respectively inserted into the through holes of said follower member; a spring member is supported between said front block of said follower member and an inside wall of said front cover to force said follower member away from said front cover toward said housing.

8. The electric plug as claimed in claim 7, wherein said spring member is a compressed spring.

* * * * *